US006996353B2

(12) United States Patent
Schell

(10) Patent No.: US 6,996,353 B2
(45) Date of Patent: Feb. 7, 2006

(54) SPRING LOADED PLASTIC TONER SEAL RETAINER

(75) Inventor: Richard P. Schell, Webster, NY (US)

(73) Assignee: Xerox Corporation, Stamford, CT (US)

( * ) Notice: Subject to any disclaimer, the term of this patent is extended or adjusted under 35 U.S.C. 154(b) by 166 days.

(21) Appl. No.: 10/760,847

(22) Filed: Jan. 20, 2004

(65) Prior Publication Data

US 2005/0158069 A1 Jul. 21, 2005

(51) Int. Cl.
*G03G 15/08* (2006.01)

(52) U.S. Cl. ..... 399/103; 399/98

(58) Field of Classification Search ..... 399/103, 399/104, 105, 98, 265, 267
See application file for complete search history.

(56) References Cited

U.S. PATENT DOCUMENTS

| | | | | | |
|---|---|---|---|---|---|
| 4,480,762 | A * | 11/1984 | Thomas | 215/273 |
| 4,823,102 | A | 4/1989 | Cherian et al. | 335/306 |
| 4,897,693 | A * | 1/1990 | Sawayama | 399/104 |
| 5,805,958 | A * | 9/1998 | Fisk | 399/98 |
| 5,987,288 | A * | 11/1999 | Mori et al. | 399/269 |
| 6,131,008 | A * | 10/2000 | Kanamori et al. | 399/263 |
| 6,341,206 | B1 * | 1/2002 | Yamaguchi et al. | 399/103 |

* cited by examiner

*Primary Examiner*—Sophia S. Chen

(57) ABSTRACT

A device for sealing a magnetic roll to a developer housing includes a plastic retainer having side walls that are spring loaded with a felt seal adhesively positioned within the side walls. The spring loaded side walls of the plastic retainer help hold the felt seal in place and facilitates ease of installation onto the magnetic rolls.

13 Claims, 3 Drawing Sheets

SPRING LOADED PLASTIC TONER SEAL RETAINER

BACKGROUND OF THE INVENTION

This disclosure relates to a developer housing, and more particularly, to a seal for a magnetic developer housing.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. Generally, the developer material comprises toner particles adhering triboelectrically to carrier granules. The toner particles attracted from the carrier granules to form a toner powder image on the photoconductive member that corresponds to the informational areas contained within the original document. This toner powder image is subsequently transferred to a copy sheet and permanently affixed thereto in image configuration.

In electrophotographic printing machines, magnetic rolls are frequently employed in the developing station and the cleaning station. Typically, the magnetic roll includes a stationary magnet having a rotating tube positioned concentrically thereabout. At the developer station, a developer material of magnetic carrier granules having toner particles adhering triboelectrically thereto is attracted to the tube by the magnetic field generated by the magnetic roll. The tube surface is usually roughened so that the frictional force between the developer material and the tube causes the developer material to rotate with the tube. The developer material is advanced by the tube to a position closely adjacent the electrostatic latent image recorded on the photoconductive member. At the cleaning station, a layer of carrier granules adheres to the tube and moves therewith. As the layer of carrier granules pass closely adjacent to the photoconductive member, residual toner particles are attracted to the layer of carrier granules and move therewith away from the photoconductive member. In this way, residual toner particles are cleaned from the photoconductive member. A copier employing a magnetic roll is shown in U.S. Pat. No. 4,823,102 issued Apr. 18, 1989 to Abraham Cherian et al.

It is critical for performance of the printer that the developer housing in which the magnetic roll is supported is sealed with respect to the magnetic roll in order to prevent toner from escaping into the insides of the printer. This has been accomplished in the past, but with excessive cost. For example, rare earth magnetic seals have been used successfully, but they are too expensive. Felt seals have been used to seal the magnetic roll to the developer housing, however, they present installation, adhesive shelf life, component contamination from adhesives, ineffective adhesives and ineffective adhesive problems which allow the magnetic roll to spin in the seal out of position with respect to the photoconductive member.

Obviously, there is still a need, in magnetic developer housings for an inexpensive magnetic roll seal.

Accordingly, a device for sealing a magnetic roll to a developer housing is disclosed that answers the above-mentioned problem by including a plastic retainer having side walls that are spring loaded with a felt seal positioned within the said walls. The spring loaded side walls of the plastic retainer hold the felt seals in place to facilitate installation onto the magnetic rolls.

BRIEF DESCRIPTION OF THE DRAWINGS

The foregoing and other features of this disclosure will be apparent and easily understood from a further reading of the specification, claims and by reference to the accompanying drawings in which like reference numerals refer to like elements and wherein:

Figure 1:
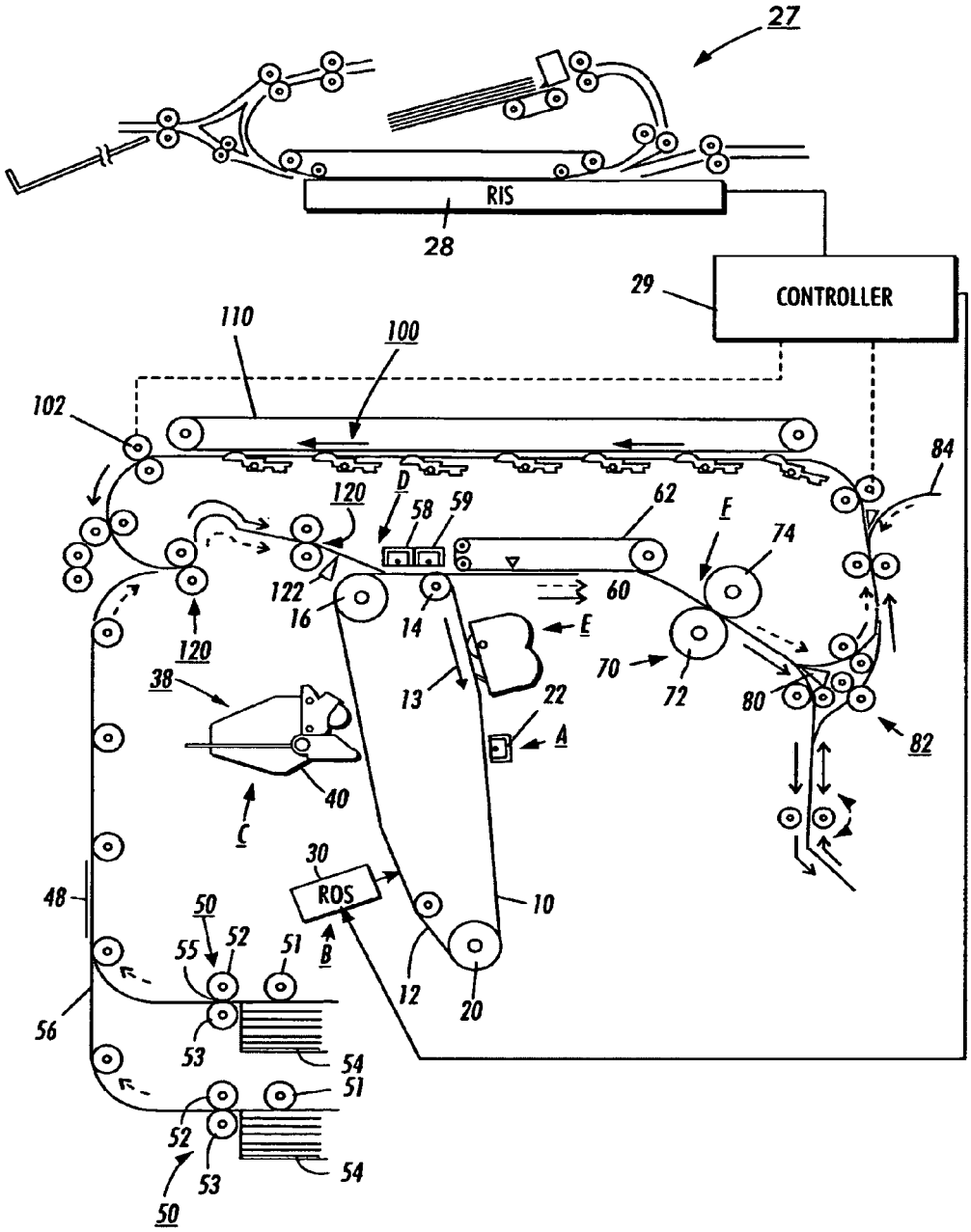
FIG. 1 is a schematic elevational view of a typical electrophotographic printing machine that includes a magnetic developer housing that employs an improved magnetic developer housing seal.

While this disclosure will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of the features of the present disclosure, reference is made to the drawings. In the drawings, like reference numerals have been used throughout to identify identical elements.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge couple device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a magnetic development unit 38 that includes a housing 40 at station C, where toner is electrostatically attracted to the latent image using commonly known techniques. The latent image attracts toner particles from the carrier granules forming a toner powder image thereon.

With continued reference to FIG. 1, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a nudger roll 51 which feeds the uppermost sheet of stack 54 to nip 55 formed by feed roll 52 and a retard roll 53. Feed roll 52 rotates to advance the sheet from stack 54 into vertical transport 56. Vertical transport 56 directs the advancing sheet 48 of support material into the registration transport 120 which, in turn, advances the sheet 48 past sheet position sensor 122 and past image transfer station D to receive an image from photoconductive belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher of stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transport station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
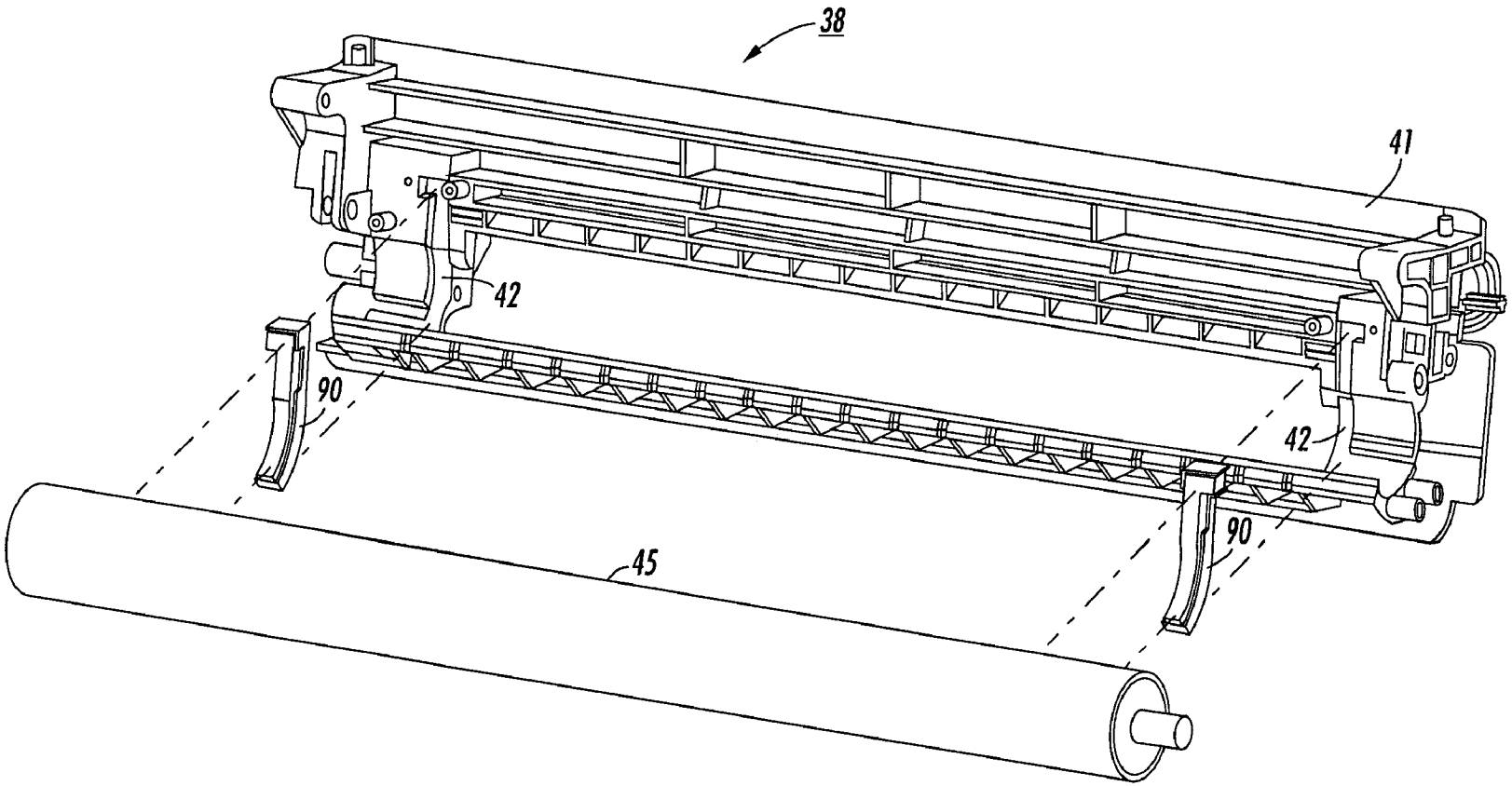
FIG. 2 is an exploded, partial schematic isometric view depicting a magnetic roll, seal and developer housing cover plate.

FIG. 2 shows a partial, exploded isometric view of magnetic developer unit 38 that includes a faceplate 41 that is a portion of magnetic developer housing 40. Faceplate 41 includes seal seats 42 that support spring loaded toner seal retainers 90. A magnetic roll 45 fits into seal retainer 90 of magnetic developer housing 40 such that toner dispensed from the housing onto magnetic roll 45 will not escape through the ends of the magnetic developer housing. Seal retainers 90 are positioned at the ends of magnetic roll 45. Heretofore, not only were there problems with installation of felt seal retainers onto the magnetic roll, but the felt seal retainers would sometimes have ineffective adhesives adhering them to a support and spinning of the magnetic roll would cause the felt seal retainers to spin out of position, and thus allowing magnetic toner to escape into the interior of the printer and affecting copy quality and printer performance.

Figure 3:
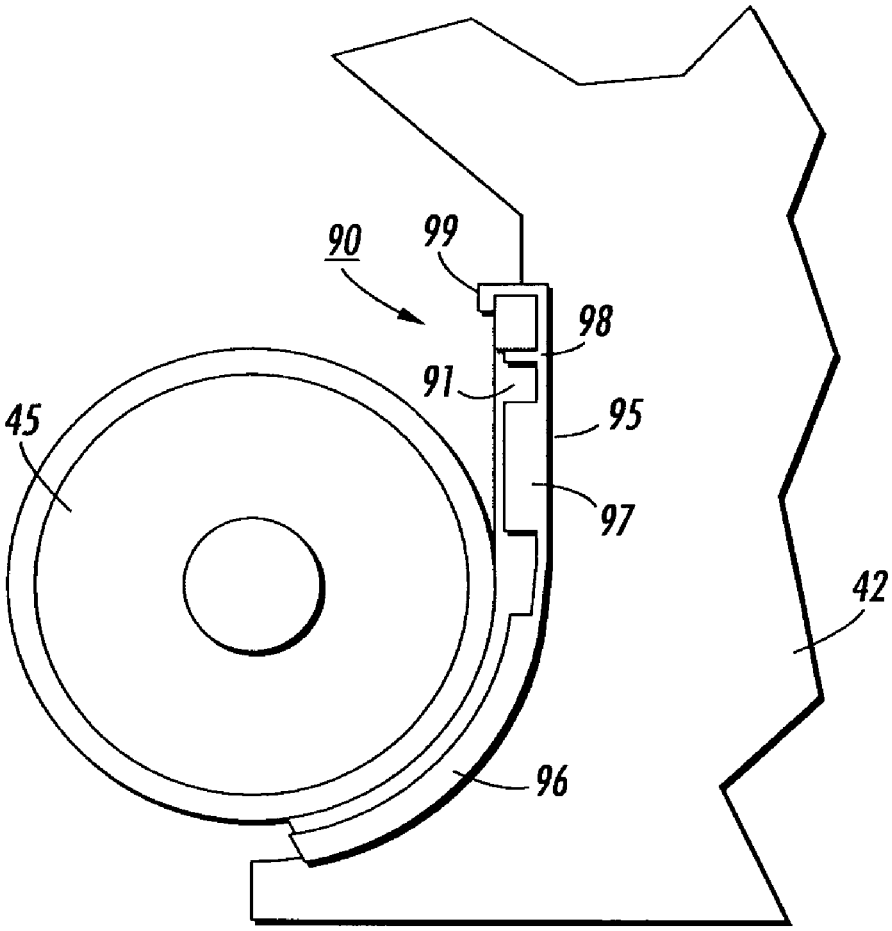
FIG. 3 is a schematic side view showing a magnetic roll sealed to a face plate of a magnetic developer housing.

Plastic toner retainer seal 90 that is used to prevent toner from escaping through the ends of magnetic roll 45 and to minimize installation of the magnetic roll onto the toner retainer seal, as shown in FIG. 3, comprises a felt seal member 91 securely positioned within a plastic retainer 95 that retains felt seal 91 by spring action that is provided by the plastic retainer members 96, 97, 98 and 99. Felt seal 91 is statically slopped into plastic retainer 95. Side plastic springs 96, 97 and 98 prevent the seal 91 from lifting out of retainer 95, and lip 99 on the upper end of retainer 95 prevents the seal from spinning out of position. The plastic retainer can be molded into any shape to fit any design parameter. A suitable adhesive could also be used to attach seal member 91 to plastic retainer 95. It should be noted that the end of plastic retainer 95 has a vertical wall 99, adapted such that, with the aid of the adhesive and the vertical wall, rotating of the seal member by magnetic roll 45 is restricted. In addition, along with the spring loaded sides of plastic retainer 95, the adhesive and vertical wall allow for consistent and ease of insertion of the felt seal 91 into developer housing 40 during assembly.

It should now be understood that an improved, less expensive, spring loaded plastic toner seal retainer has been disclosed that prevents toner from escaping through the ends of magnetic rolls positioned to receive toner from a magnetic developer housing. A felt seal is retained within the plastic retainer by spring action that is provided by the plastic retainer.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. An apparatus for use in a processing station of an electrostatographic printing machine, comprising:

a seal member; and a plastic retainer member adapted to hold said seal member, said plastic retainer member including side panels for preventing said seal member from lifting out of said plastic retainer, and a lip member that prevents said seal member from spinning out of a preset position, and wherein said side panels are spring loaded.

2. The apparatus of claim 1, wherein said seal member is made of felt material.

3. The apparatus of claim 2, wherein said seal member is attached to said plastic retainer with an adhesive.

4. An electrophotographic printing machine of the type having an electrostatic latent image recorded on a photoconductive surface developed by toner to form a visible image thereof, comprising:

a housing defining a chamber adapted to store a supply of magnetic developer therein;

a magnetic roll adapted to remove magnetic toner from said chamber and deposit it onto said photoconductive surface; and a sealing device adapted to prevent toner from escaping through the ends of said magnetic roll, said sealing device including a seal positioned within a plastic retainer, and wherein said seal is retained within said plastic retainer by spring action that is provided by said plastic retainer.

5. The electrophotographic printing machine of claim 4, wherein said seal is made of felt material.

6. The electrophotographic printing machine of claim 5, wherein said retainer includes a plurality of side panels with said side panels being adapted to prevent said seal from lifting out of said plastic retainer during use.

7. The electrophotographic printing machine of claim 6, wherein said plastic retainer includes a lip adapted to prevent said seal from spinning out of a preset position.

8. The electrophotographic printing machine of claim 5, wherein said seal is attached to said plastic retainer with an adhesive.

9. A magnetic development system suitable for developing an electrostatic image, comprising:

a housing defining a chamber adapted to store a supply of magnetic developer therein;

a magnetic roll adapted to remove magnetic toner from said chamber and deposit it onto a photoconductive surface; and a sealing device adapted to prevent toner from escaping through the ends of said magnetic roll, said sealing device including a seal positioned within a plastic retainer, and wherein said seal is retained within said plastic retainer by spring action that is provided by said plastic retainer.

10. The magnetic development system of claim 9, wherein said seal is made of felt material.

11. The magnetic development system of claim 10, wherein said retainer includes a plurality of side panels with said side panels being adapted to prevent said seal from lifting out of said plastic retainer during use.

12. The magnetic development system of claim 11, wherein said plastic retainer includes a lip adapted to prevent said seal from spinning out of a preset position.

13. The magnetic development system of claim 12, wherein said seal is positioned within said plastic retainer with an adhesive.

* * * * *